US007338023B2

(12) United States Patent
Liu

(10) Patent No.: US 7,338,023 B2
(45) Date of Patent: Mar. 4, 2008

(54) KEYBOARD CARRIER

(76) Inventor: Chi Way Liu, 235 Chung-Ho Box 8-24, Taipei (TW)

( * ) Notice: Subject to any disclaimer, the term of this patent is extended or adjusted under 35 U.S.C. 154(b) by 748 days.

(21) Appl. No.: 11/042,485

(22) Filed: Jan. 26, 2005

(65) Prior Publication Data

US 2006/0175500 A1 Aug. 10, 2006

(51) Int. Cl.
*E04G 3/00* (2006.01)

(52) U.S. Cl. ..... 248/284.1; 248/918; 248/281.11; 248/278.1; 248/286.1; 108/140

(58) Field of Classification Search ..... 248/281.11, 248/918, 118.3, 274.1, 276.1, 278.1, 286.1, 248/279.1, 284.1, 280.11, 292.13, 285.1, 248/292.14, 291.1, 292.12; 108/140, 138
See application file for complete search history.

(56) References Cited

U.S. PATENT DOCUMENTS 6,021,985 A * 2/2000 Hahn ..... 248/286.1
6,027,090 A * 2/2000 Liu ..... 248/281.11
6,533,229 B1 * 3/2003 Hung ..... 248/286.1
6,883,764 B1 * 4/2005 Mileos et al. ..... 248/281.11
2004/0195481 A1 * 10/2004 Huh ..... 248/274.1
2004/0262477 A1 * 12/2004 Whitaker et al. ..... 248/284.1

* cited by examiner

*Primary Examiner*—Kimberly Wood

(57) ABSTRACT

A keyboard carrier for adjusting elevation and inclination of a keyboard position thereon includes a locating mechanism, which includes an outer sleeve, a braking block axially movably disposed in the outer sleeve, a screw rod having an end pivotally connected to the keyboard carrier and the other end perpendicularly extended through the outer sleeve and a round hole on the braking block, a handle located at an end of the outer sleeve, and a pivoting mechanism connected to an inner end of the handle and having a screw bolt screwed into a central axis of the braking block. When the handle is pivotally turned to axially move the braking block in the outer sleeve with the screw rod engaged with a threaded section on the round hole of the braking block, the keyboard carrier is stably supported by the screw rod without the risk of moving.

2 Claims, 7 Drawing Sheets

KEYBOARD CARRIER

FIELD OF THE INVENTION

The present invention relates to a keyboard carrier for adjusting elevation and inclination of a keyboard positioned thereon, and more particularly to a keyboard carrier that includes a locating mechanism having high supporting ability to locate the keyboard carrier in place after the keyboard carrier has been adjusted to desired elevation and inclination.

BACKGROUND OF THE INVENTION

In the prior art, the keyboard carrier includes a base for fixedly connecting to an underside of a desk, a slide seat slidably mounted between two sliding rails formed below two lateral edges of the base, a bracket mount connected to an underside of the slide seat, a pair of links and an elevating member pivotally connected at respective rear ends to two front ends of the bracket mount to form a link mechanism for adjusting a height of front ends of the links and the elevating member relative to the desk, and an inclining member pivotally connected at two rear ends to two front ends of the elevating member via a long shaft of a quick-detachable mechanism located below the inclining member. The long shaft is extended through two curved slots formed at the front ends of the elevating member and thereby allows the inclining member to slide in the curved slots for adjusting an inclination of the inclining member relative to the desk.

Since the quick-detachable mechanism is provided at pivoting points between the elevating member and the two links, as well as the pivoting points between the inclining member and the elevating member, locking of the quick-detachable mechanism in place would also lock the pivoting points on the link mechanism formed from the elevating member and the links, as well as the pivoting points between the elevating and the inclining member, causing the keyboard carrier to be locked to the adjusted elevation and inclination at the same time.

The quick-detachable mechanism includes a long shaft disposed in a quick detachable sleeve. When the long shaft is tightened, the links, the elevating member, and the inclining member are brought to closely contact with one another at the pivotally connected positions, so that the pivoting points become immovable to achieve the locating effect. However, the above-described quick-detachable mechanism provides only a very limited supporting force. When an excessive force is applied on the keyboard carrier, or the keyboard carrier has been used over a prolonged time, the quick-detachable mechanism tends to become loose from the keyboard carrier and fails to stably support the keyboard carrier.

SUMMARY OF THE INVENTION

A primary object of the present invention is to provide a keyboard carrier that includes a new locating mechanism to replace the conventional quick-detachable mechanism, so that the keyboard carrier is more stably supported and fixed to an adjusted position.

To achieve the above and other objects, the locating mechanism included in the keyboard carrier of the present invention includes an outer sleeve, a braking block axially movably disposed in the outer sleeve, a screw rod having an end pivotally connected to the keyboard carrier and the other end perpendicularly extended through the outer sleeve and a round hole on the braking block, a handle located at an end of the outer sleeve, and a pivoting mechanism connected to an inner end of the handle and having a screw bolt screwed into a central axis of the braking block. When the handle is pivotally turned to axially move the braking block in the outer sleeve with the screw rod engaged with a threaded section formed on one side of the round hole of the braking block, the keyboard carrier is stably supported by the screw rod without the risk of moving, enabling a user to operate the keyboard more conveniently.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
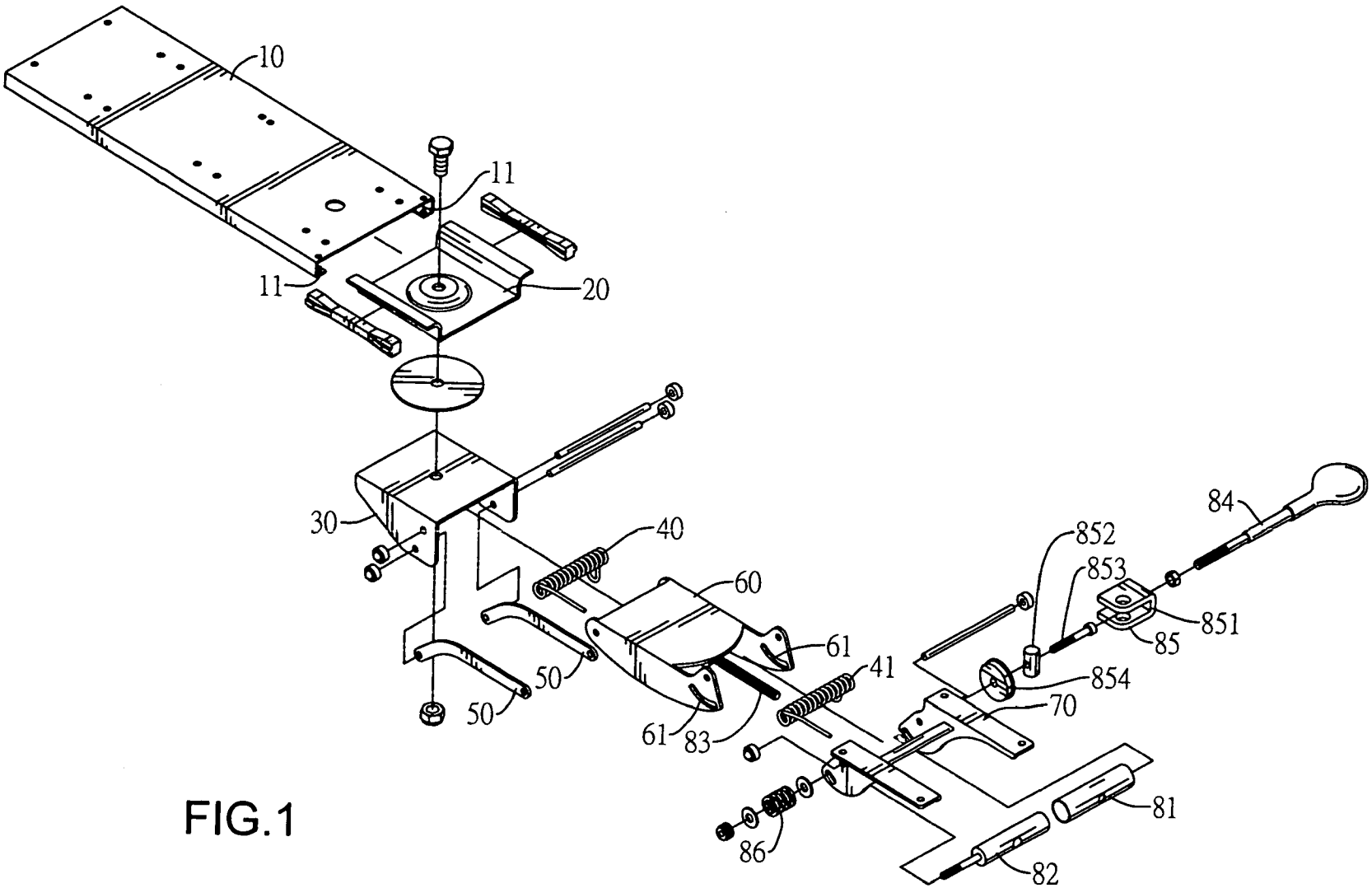
FIG. 1 is an exploded perspective view of a keyboard carrier according to the present invention.
Figure 2:
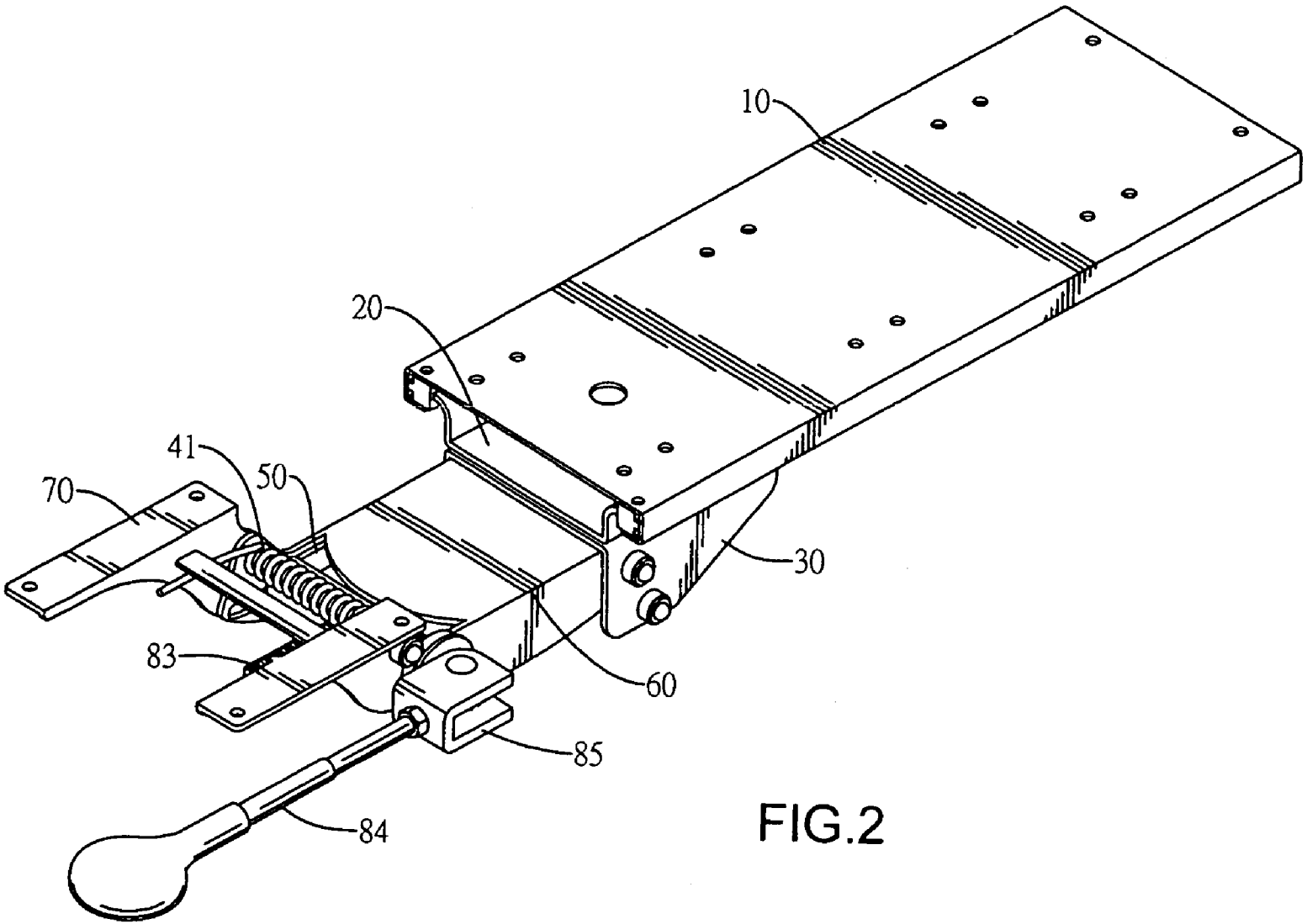
FIG. 2 is an assembled top perspective view of the keyboard carrier of the present invention.
Figure 3:
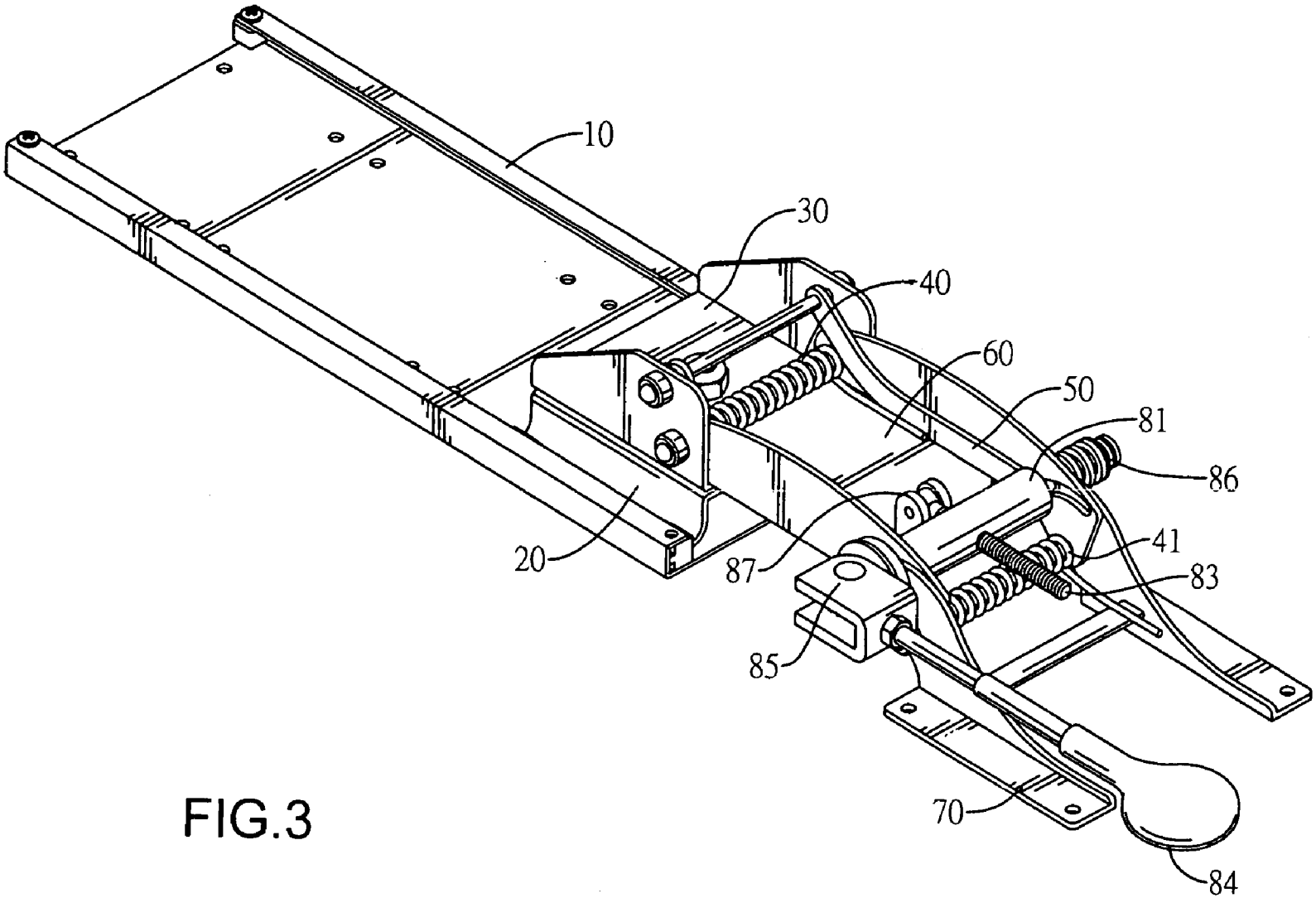
FIG. 3 is an assembled bottom perspective view of the keyboard carrier of the present invention.

Please refer to FIGS. 1, 2, and 3 which are exploded, and assembled top and bottom perspective views, respectively, of a keyboard carrier according to the present invention. As shown, the keyboard carrier includes a base 10 for fixedly connecting to an underside of a desk, a slide seat 20 slidably mounted between two sliding rails 11 formed below two lateral edges of the base 10, a bracket mount 30 connected to an underside of the slide seat 20, a pair of links 50 and an elevating member 60 pivotally connected at respective rear ends to two front ends of the bracket mount 30 to form a link mechanism for adjusting a height of front ends of the links 50 and the elevating member 60 relative to the desk, and an inclining member 70 pivotally connected at two rear ends to two front ends of the elevating member 60 via a locating mechanism to slide in two curved slots 61 formed at the front ends of the elevating member 60 and thereby adjust an inclination of the inclining member 70 relative to the desk.

The link mechanism formed from the links 50 and the elevating member 60 to also function as an elevation adjusting mechanism and the inclining member 70 that forms an inclination adjusting mechanism are elastically returnable to their respective original positions under a restoring force separately provided by a first and a second elastic element 40, 41, as in the keyboard carrier disclosed in Taiwanese New Utility Model Patent Application No. 093206862.

The keyboard carrier of the present invention is characterized in the locating mechanism that replaces the quick-detachable mechanism in the above-mentioned Taiwanese New Utility Model Patent Application No. 093206862.

As can be most clearly seen from FIG. 1, the locating mechanism of the present invention mainly includes an outer sleeve 81, a braking block 82 received in the outer sleeve 81, a screw rod 83 perpendicularly extended through the outer sleeve 81 and the braking block 82, a handle 84, a pivoting mechanism 85, and an elastically movable end shaft 86.

Figure 6:
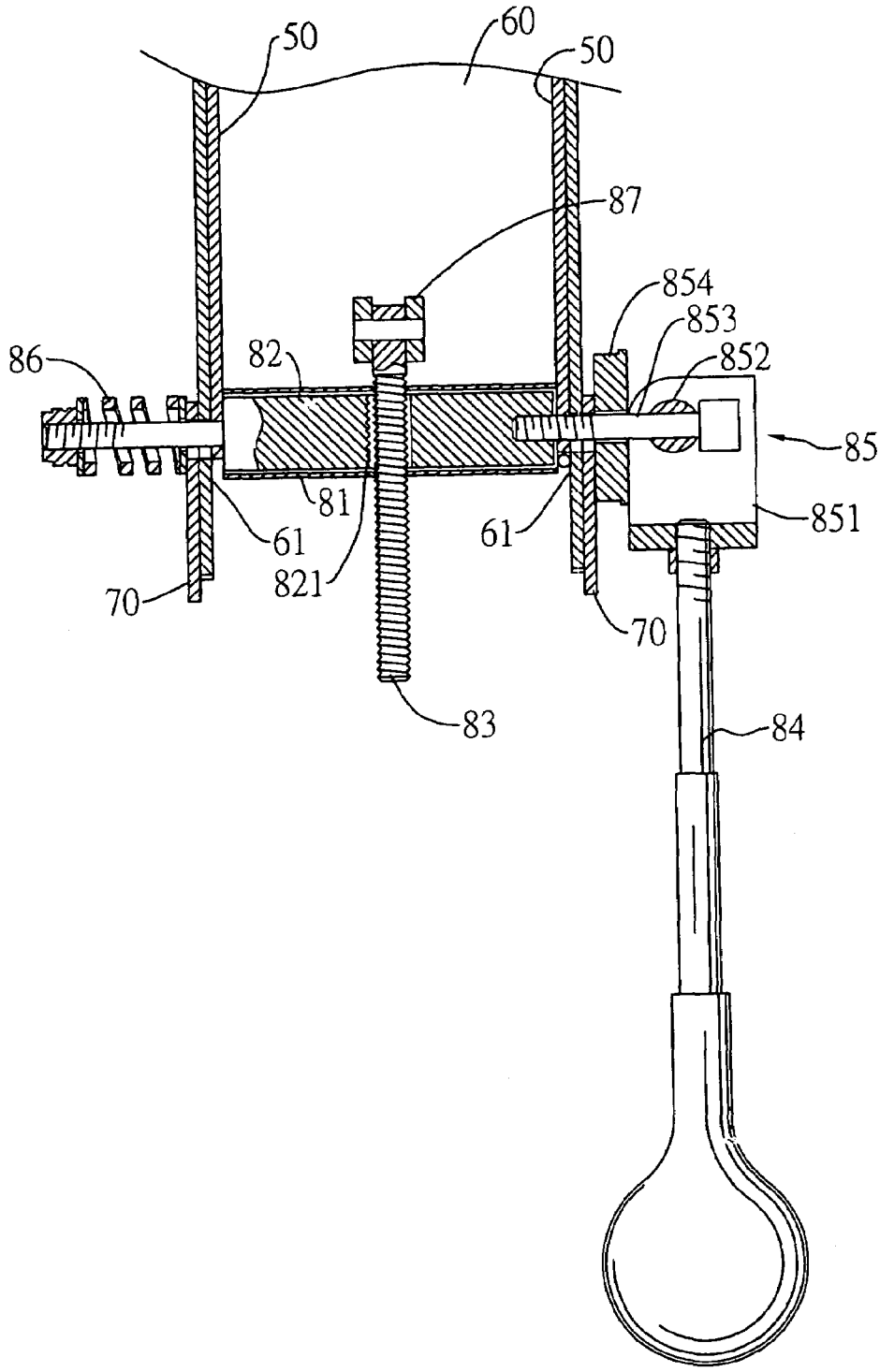
FIG. 6 shows the operation of a locating mechanism included in the present invention to allow adjustment of elevation and inclination of the keyboard carrier of the present invention.

The screw rod 83 is pivotally connected at an end to an underside of the elevating member 60 via a pivoting support 87, as can be seen from FIGS. 3 and 6, to perpendicularly extend an opposite end through the outer sleeve 81 and the braking block 82. It is noted a round hole on the braking block 82 for the screw rod 83 to extend therethrough is provided at one side of an inner wall closer to the end shaft 86 with a threaded section 821 (see FIG. 6).

The outer sleeve 81 is disposed between the two curved slots 61 formed at two front ends of the elevating member 60. The braking block 82 has a length slightly smaller than that of the outer sleeve 81 and is therefore axially movable in the outer sleeve 81. The handle 84 is located at one outer side of the elevating member 60 to be manually operated for turning the pivoting mechanism 85.

The pivoting mechanism 85 includes a U-shaped seat 851 having a top and two sidewalls. The handle 84 is screwed at an inner end to the top of the U-shaped seat 851, a pivot shaft 852 perpendicularly extends through the two sidewalls of the U-shaped seat 851, and a screw bolt 853 radially and perpendicularly extends through the pivot shaft 852. A washer 854 is disposed between the U-shaped seat 851 of the pivoting mechanism 85 and the curved slot 61 of the elevating member 60. The screw bolt 853 extends through the washer 854 and the curved slot 61 to screw into a central axis of the braking block 82 via an end thereof. The elastically movable end shaft 86 is screwed into the central axis of the braking block 82 via the other end thereof.

Figure 4:
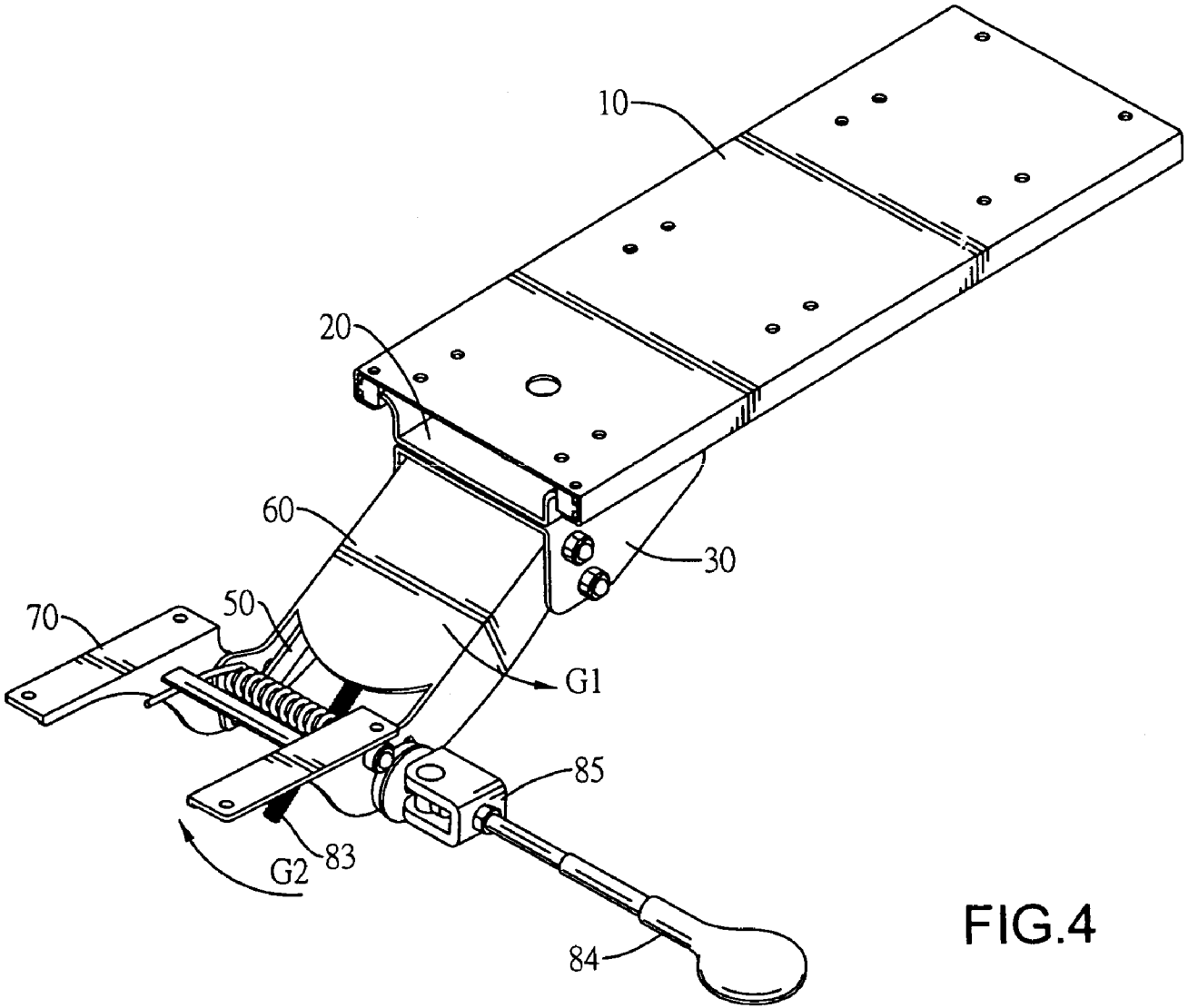
FIG. 4 is a perspective view showing the manner of adjusting the elevation and inclination of the keyboard carrier of the present invention.
Figure 7:
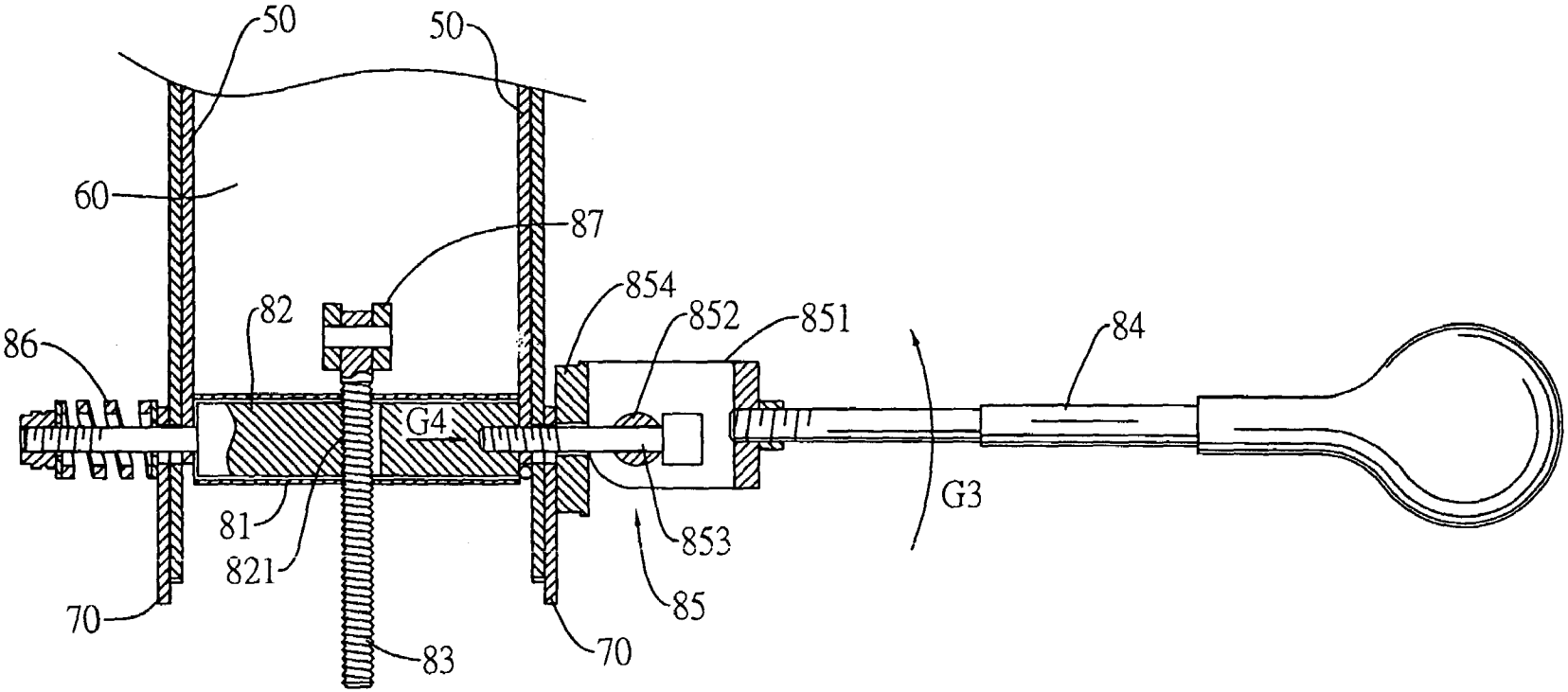
FIG. 7 shows the operation of the locating mechanism included in the present invention to lock the keyboard carrier of the present invention to the adjusted elevation and inclination.

Please refer to FIGS. 6 and 7. When it is desired to adjust the elevation and the inclination of a keyboard on the keyboard carrier of the present invention, first pull the handle 84 to a position parallel to the elevating member 60 as shown in FIG. 6. At this point, the screw bolt 853 of the pivoting mechanism 85 pushes the braking block 82 toward the elastically movable end shaft 86 to separate from the links 50 and the elevating member 60, so that the elevation adjusting mechanism formed from the elevating member 60 and the links 50 is pivotally turnable about a rear end thereof relative to the bracket mount 30, as indicated by the arrow G1 in FIG. 4, and the inclining member 70 is movable in the curved slots 61 to different inclined positions, as indicated by the arrow G2 in FIG. 4.

When the keyboard carrier has been adjusted to desired elevation and inclination, the handle 84 is turned to a position perpendicular to the elevating member 60 as shown in FIG. 7, and the pivoting mechanism 85 is pivotally turned at the same time. At this point, the U-shaped seat 851 is pivotally turned on the washer 854 to cause the screw bolt 853 to pull the braking block 82 away from tile elastically movable end shaft 86, as indicated by the arrow G4, to tightly press against the washer 854, so that all pivoting points on the elevation adjusting mechanism formed from the elevating member 60 and the links 50 and the inclination adjusting mechanism formed from the inclining member 70 and the curved slots 61 are immovable.

Figure 5:
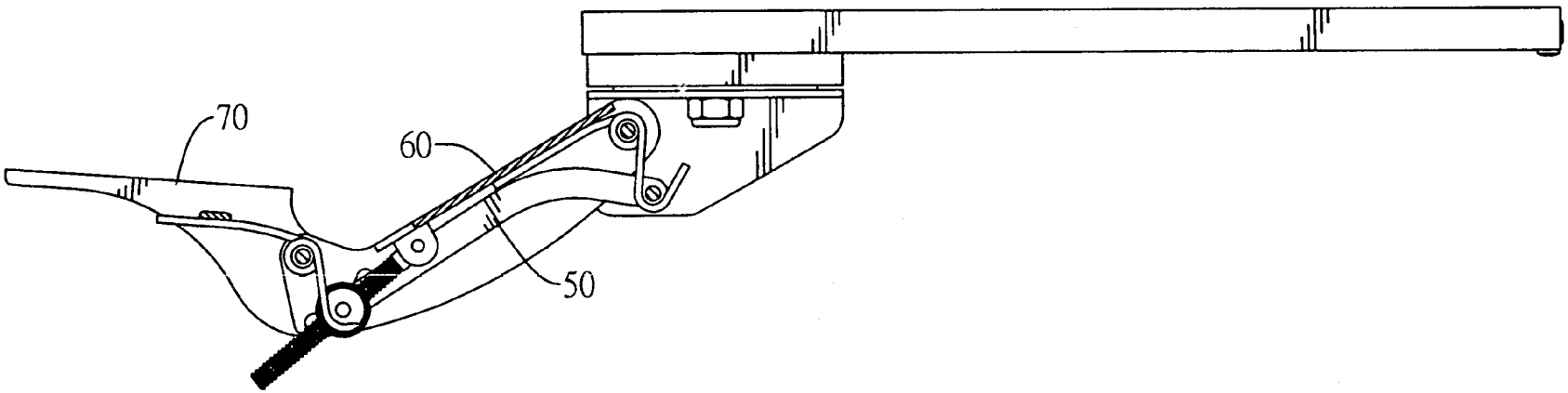
FIG. 5 is a partially sectioned side view of FIG. 4.

Meanwhile, when the braking block 82 is moved to tightly press against the washer 854, the threaded section 821 on one side of the round hole on the braking block 82 engages with threads on the screw rod 83, preventing the screw rod 83 from axially moving relative to the braking block 82 and the outer sleeve 81. Please refer to FIG. 5. The screw rod 83 locked to the braking block 82 further provides the elevating member 60 and the inclining member 70 with a supporting force to largely enhance a locating ability of the locating mechanism. In other words, the keyboard carrier of the present invention with the screw rod 83 has a largely upgraded supporting ability after the keyboard carrier has been adjusted to a desired working position.

Mechanically speaking, the screw rod 83 fixedly located between the two links 50 as well as two sides of the elevating member 60 enables the locating mechanism of the present invention to have an upgraded supporting ability.

Reversely, when it is desired to adjust the elevating member 60 and the inclining member 70 again, simply turn the handle 84 in a direction as indicated by the arrow G3 in FIG. 7, so that the handle 84 is returned to the position as shown in FIG. 6. At this point, the braking block 82 is moved toward the elastically movable end shaft 86 and no longer pressed against the washer 854, and the threaded section 821 on the round hole of the braking block 82 disengages from the screw rod 83 to release the latter, allowing the elevating member 60 and the inclining member 70 to be adjusted again.

The screw rod 83 obviously enables the locating mechanism of the present invention to have a largely enhanced supporting ability after the keyboard carrier has been locked to the adjusted position, making the adjusted keyboard carrier more stable without the risk of moving any further.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A keyboard carrier, comprising a base for fixedly connecting to an underside of a desk, a slide seat slidably mounted between two sliding rails formed below two lateral edges of said base, a bracket mount connected to an underside of said slide seat, a pair of links and an elevating member pivotally connected at respective rear ends to two front ends of said bracket mount to form an elevation adjusting mechanism for adjusting a height of front ends of said links and said elevating member relative to the desk, and an inclining member pivotally connected at two rear ends to two front ends of said elevating member via a locating mechanism to slide in two curved slots formed at the front ends of said elevating member for adjusting an inclination of said inclining member relative to the desk; and said locating mechanism including:

an outer sleeve disposed between said two curved slots formed at two front ends of said elevating member;

a braking block having a length slightly smaller than that of said outer sleeve and therefore being axially movable in said outer sleeve, and said braking block being provided at a predetermined position with a round hole, one side of an inner wall of said round hole being provided with a threaded section;

a screw rod being pivotally connected at an end to an underside of said elevating member to perpendicularly extend an opposite end through said outer sleeve and said round hole of said braking block;

a handle being located at one outer side of said elevating member to be manually operated and pivotally turned;

a pivoting mechanism being located between said handle and said braking block, and operable by pivotally turning said handle to axially move said braking block in said outer sleeve; and an elastically movable end shaft being located at one outer side of said elevating member opposite to said handle, and screwed to an end of said braking block;

whereby when said handle is pivotally turned from a first position to a second position, said braking block is axially moved in said outer sleeve to tightly press an end against said pivoting mechanism, and said elevation adjusting mechanism and said inclination adjusting mechanism are immovably clamped between said braking block and said washer without the risk of turning, and said screw rod extended through said round hole on said braking block is engaged with said threaded section of said round hole to provide an enhanced supporting force to said keyboard carrier.

2. The keyboard carrier as claimed in claim 1, wherein said pivoting mechanism includes a U-shaped seat having a top and two sidewalls, said handle being screwed at an inner end to the top of said U-shaped seat; a pivot shaft perpendicularly extended through the two sidewalls of said U-shaped seat; a screw bolt radially and perpendicularly extended through said pivot shaft; and a washer disposed between said U-shaped seat of said pivoting mechanism and said curved slot of said elevating member; and said screw bolt extended through said pivot shaft being further extended through said washer and said curved slot to screw into a central axis of said braking block via an end thereof.

* * * * *